US005495681A

United States Patent [19]

Paradis

[11] Patent Number: 5,495,681

[45] Date of Patent: Mar. 5, 1996

[54] PIVOTABLE PANEL FOR CLOTHES DRYER DRUM

[76] Inventor: André Paradis, 22, rue de l'Aqueduc, C.P. 102 Ste-Brigitte-de-Laval, Québec, Canada, G0A 3K0

[21] Appl. No.: 447,858

[22] Filed: May 24, 1995

[51] Int. Cl.[6] ..... F26B 11/02

[52] U.S. Cl. ..... 34/602; 34/595

[58] Field of Search ..... 34/602, 599, 595

[56] References Cited

U.S. PATENT DOCUMENTS

| | | | |
|---|---|---|---|
| 3,815,258 | 6/1974 | Beard, Jr. | 34/602 |
| 3,840,998 | 10/1974 | Marcussen | 34/599 |
| 5,388,344 | 2/1995 | Wallach | 34/602 |

FOREIGN PATENT DOCUMENTS

| | | | |
|---|---|---|---|
| 3438574 | 4/1986 | Germany | 34/602 |

*Primary Examiner*—John T. Kwon
*Attorney, Agent, or Firm*—Francois Martineau; Pierre Lesperance

[57] ABSTRACT

A panel assembly for use inside the rotatable drum of a clothes dryer for drying plastic containing clothes. The panel assembly comprises: (a) a perforated panel having a plurality of bores, this panel being of a size adapted to conform to the shape of a peripheral sector portion of the drum; (b) polytetrafluoroethylene coating the perforated panel for preventing the lint, dust, and plastic parts of the clothes from accidentally sticking to the panel and from clogging the panel bores; (c) a piano hinge, for edgewisely mounting the panel to the interior wall of the drum sector portion for relative movement of the panel between a closed position, in which the panel generally conforms to the drum sector portion spacedly therefrom, and an open position, in which the panel extends transversely to the drum sector portion interiorly thereof. The panel is releasably locked at its closed position by screws extending through the drum wall and through a panel flange located opposite the piano hinge. Accordingly, when the clothes dryer is in operation, the perforated panel is at a lower temperature than the rotating drum wall, thus reducing the likelihood of heat fusing of the clothes plastic parts against the perforated panel.

7 Claims, 3 Drawing Sheets

Fig. 4
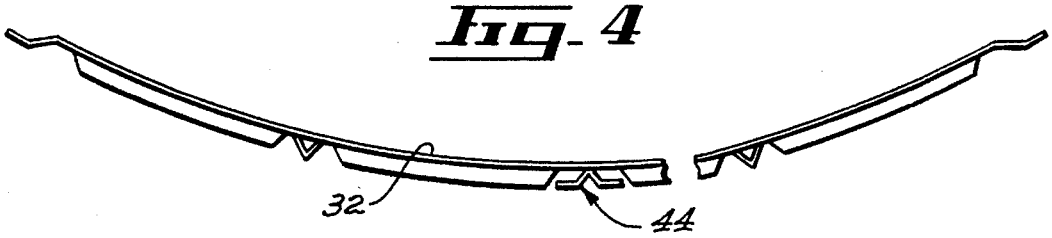
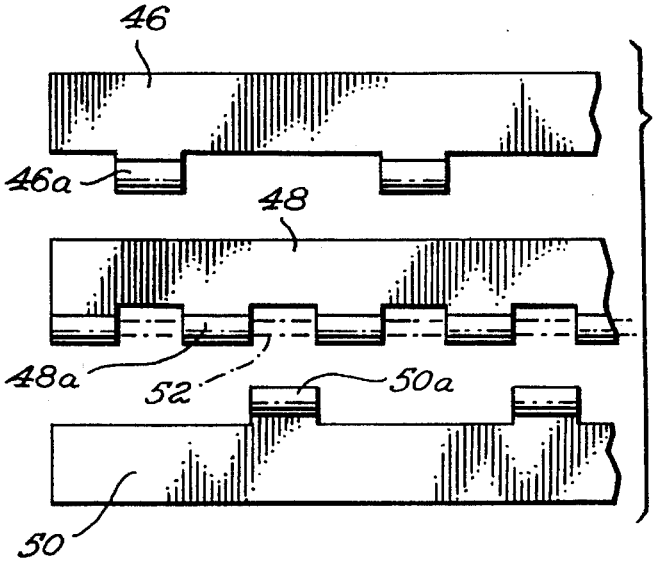
Fig. 5
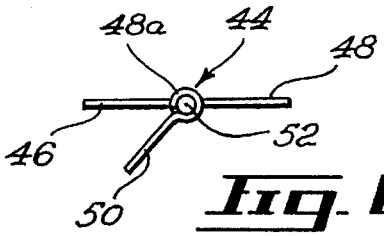
Fig. 6
Fig. 7
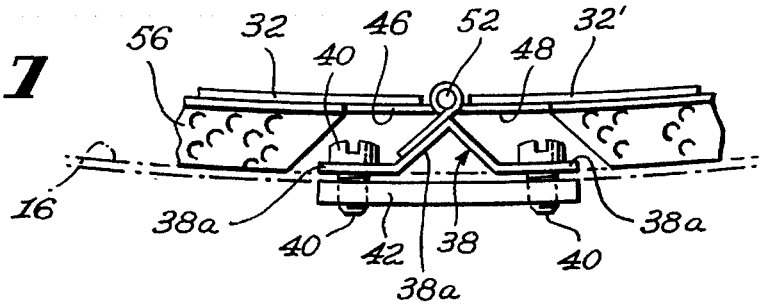
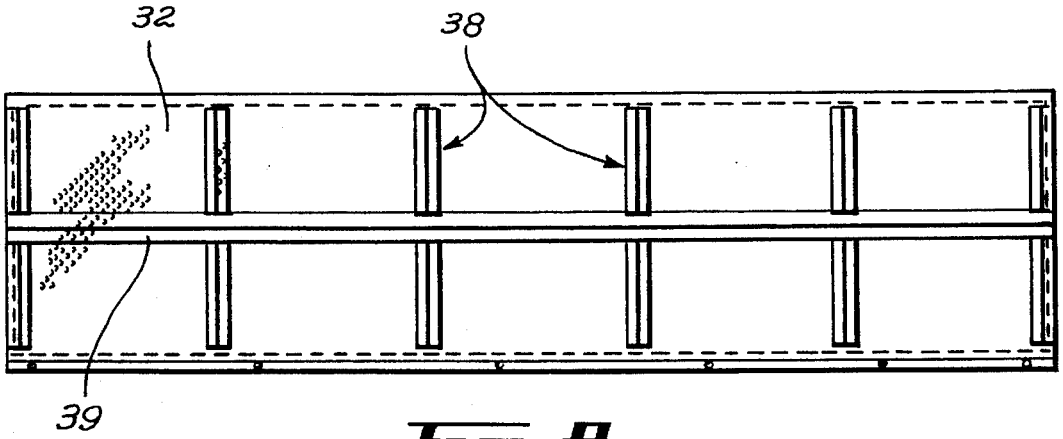
Fig. 8

PIVOTABLE PANEL FOR CLOTHES DRYER DRUM

FIELD OF THE INVENTION

This invention relates to industrial clothes dryer, and more specifically to the management of debris material generated during clothes drying operations, and in particular of clothes used by medical installation personnel.

BACKGROUND OF THE INVENTION

Conventional industrial clothes dryers consist of a cylindrical drum rotatably Dowered along a horizontal axle. The drum is perforated, and is adapted to support a load of damp clothing. Warm dry air flows transversely through the bores of the perforated drum, to air dry the clothing.

A problem associated with such industrial drums, particularly those used in hospitals for cleaning clothes of medical personnel, pertains to the fabric lint, general linen, and the plastic material from these clothes during their drying inside the drum: the plastic material in particular tends under static electricity forces and also centrifugal forces to adhere to the interior wall of the drum. Because the drum interior wall is hot, due to mainly convective, but also to some extent conductive and radiative heat transfer forces, heat fusion of the plastic material occurs against the drum interior wall, thus eventually clogging the bores of the perforated drum. Unclogging the rotating drum bores by removing the melted or fused plastic material adhered to the drum interior wall is a relatively lengthy operation, which means that the industrial dryer unit does not operate during that time. This downtime, which occurs relatively frequently, reduces the efficiency of operations of industrial dryer units, and thus increases labour costs.

OBJECTS OF THE INVENTION

The gist of the invention is therefore to improve the efficiency of operation of industrial clothes dryer units, and particularly those used by hospitals for heat drying medical personnel clothes.

A more specific object of the invention is to substantially prevent adherence on the dryer drum of plastic debris generated during operation of the clothes dryer.

SUMMARY OF THE INVENTION

In accordance with the objects of the invention, there is disclosed a panel assembly for use inside the rotatable perforated drum of an industrial clothes dryer for heat drying damp clothes made at least partially from plastic material, said panel assembly comprising: (a) a perforated panel member having a plurality of bores, said panel member having a shape adapted to be complementary to that of a peripheral sector portion of said drum; (b) an anti-adhesive compound, coating said perforated panel member for preventing lint and dust debris and plastic parts of the clothes from accidentally sticking to the panel member, and for preventing clogging of said panel member bores by the lint and dust debris; (c) mounting means, for edgewisely mounting said panel member releasably to the interior wall of said drum peripheral sector portion for relative movement of said panel member between a closed position, in which said panel member generally conforms to said drum peripheral sector portion spacedly therefrom, and an open position, in which said panel member extends transversely to said drum peripheral sector portion radially interiorly thereof; and (d) locking means, for releasably locking said panel member in its said closed position; wherein said panel member will sustain lower thermal transfer loads from thermal elements forming part of the clothes dryer, compared to those sustained by the rotatable drum, wherein heat fusing of the clothes plastic parts with said panel member is substantially prevented.

Preferably, said anti-adhesive compound is polytetrafluoroethylene.

Said mounting means could be a piano-hinge member, being fixedly anchored to said drum peripheral sector portion and pivotally mounting said panel member for radial displacement within said drum. It is also envisioned to provide rigid spacer stiffening strips, carried by said panel member and projecting from its exterior face, said stiffening strips frictionally engaging said drum section in said closed position of the panel member;

wherein conductive thermal transfer is limited to a minimum. The panel member could then form an arcuate quadrangular panel, for complementary engagement with an arcuate said sector portion of a cylindrical said drum.

It is particularly envisioned to use the panel assembly in combination with a second said panel assembly, both said panel mem-bers being hinged by the same said piano-hinge member to the drum.

Preferably, the thickness of said polytetrafluoroethylene coating over said panel member is substantially constant and ranges between about 25 and 31 micrometers.

BRIEF DESCRIPTION OF THE DRAWINGS

FIG. 4 is an edge view, at a reduced scale, of the rotary dryer drum and associated pivotal panels;

FIG. 5 is an exploded view of the piano hinge assembly mounting the interior pivotal panels to the dryer cylindrical drum;

FIG. 6 is an enlarged scale end view in isolation of the piano hinge assembly of FIG. 5;

FIG. 7 is a view similar to FIG. 6, but showing the piano hinge as operatively attached to a wall section of the dryer drum, and coupled to a pair of adjacent pivotal panels; and FIG. 8 is a developed plan view of the interior of a pivotal panel member according to the present invention.

DETAILED DESCRIPTION OF THE DRAWINGS

Figure 1:
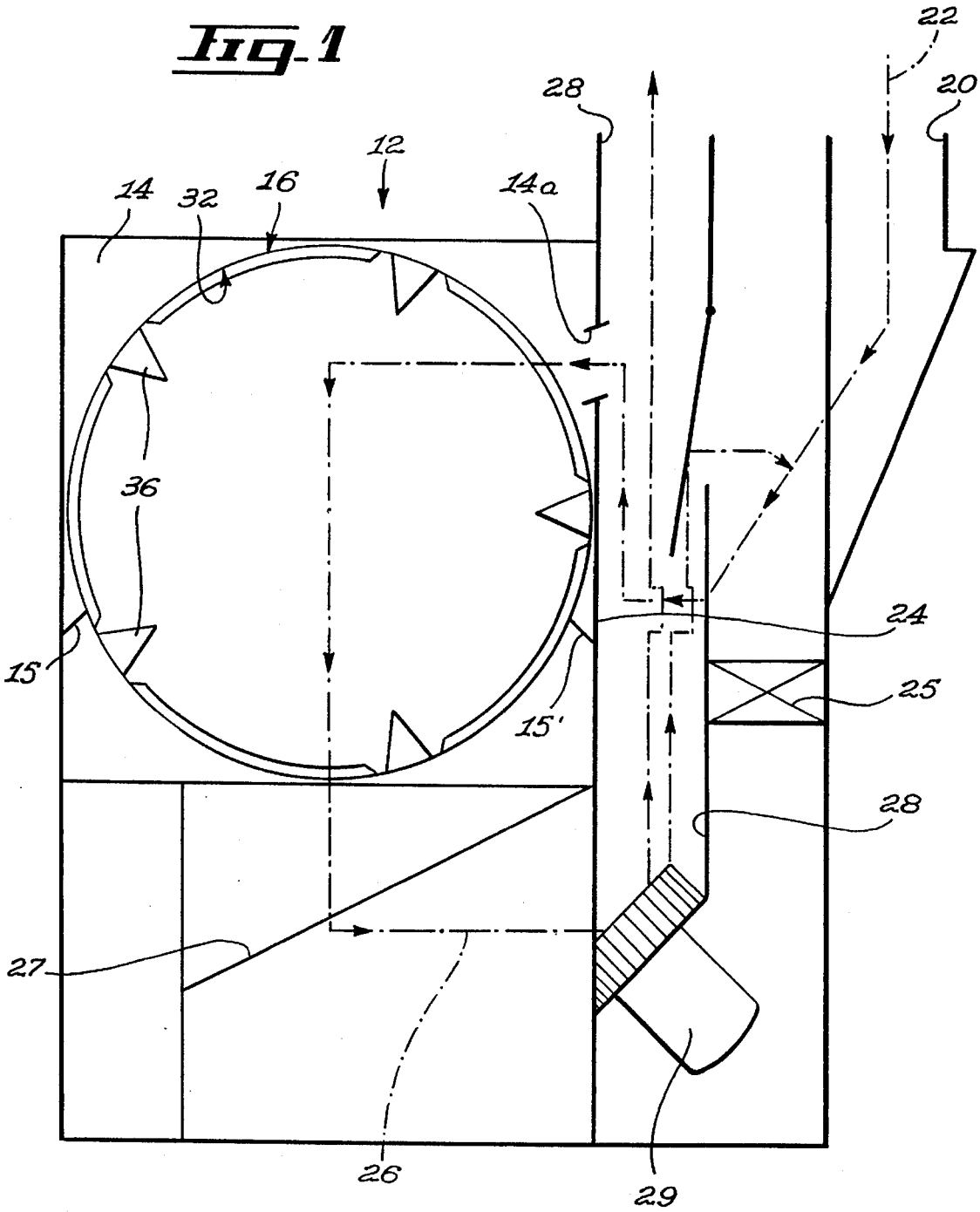
FIG. 1 is a schematic view of an industrial clothes dryer unit, suggesting by the arrows the incoming warm air flow and the stale air outflow.
Figure 3:
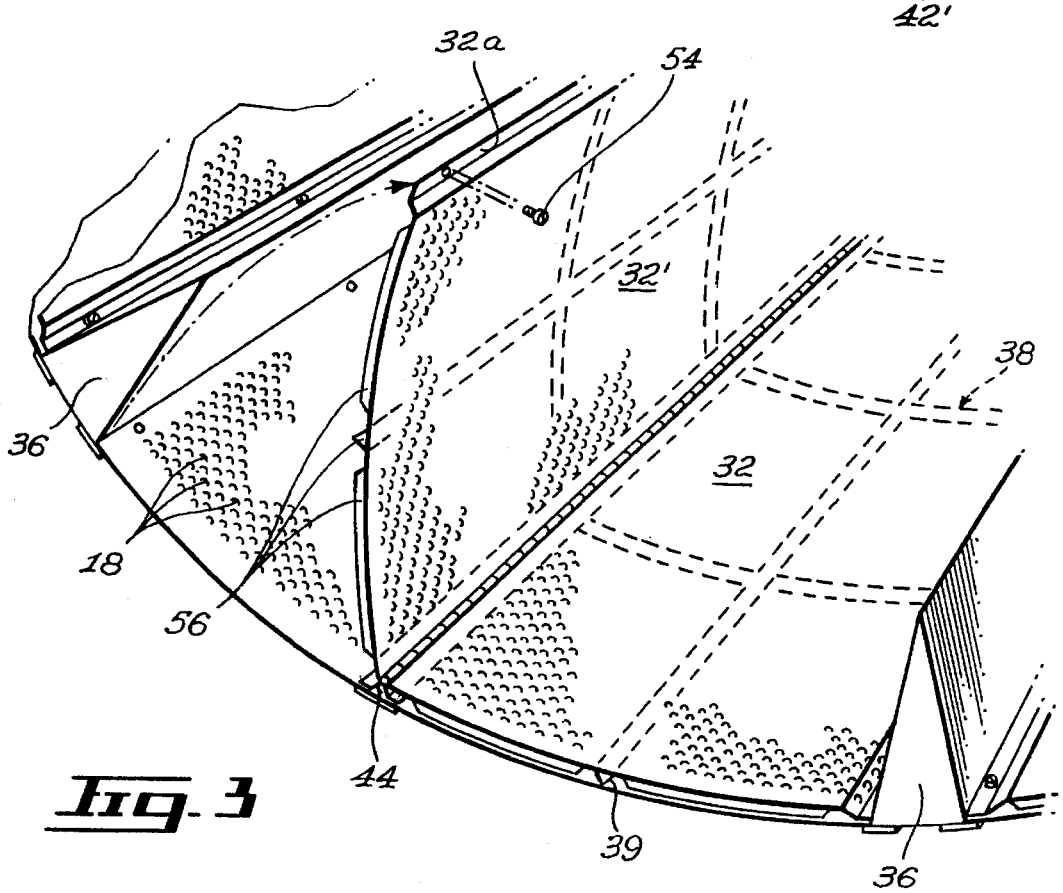

An industrial clothes dryer unit is shown as 12 in FIG. 1. Dryer unit 12, for example a LAVATEC TT 756G model, includes a ground standing main casing 14, through which is rotatably driven a horizontal drive shaft (not shown) carrying a large cylindrical drum 16. The wall of the cylindrical drum 16 is perforated with a plurality of bores 18 (FIG. 3). A first duct 20 brings forced atmospheric air flow 22 through a passage 24 made in the upper section of casing 14, where a burner 25 heats and dries this incoming air. This warmed dried air is then allowed to flow further transversely horizontally through an upper aperture **14*a* made in casing 14, and radially through the bored wall of drum 16, where the warm air dries damp clothes loaded inside rotating drum 16. The structural components of the dryer unit 12** are usually heat conductive, for example of metallic make—preferably stainless steel—, to promote to a small extent thermal transfers to the load of clothes inside the cylindrical drum—of course, clothes drying occur mainly by warm air drafts (convection currents).

Stale air loaded with humidity from the damp clothes inside the drum 16 escapes downwardly from drum 16, radially through the drum bored wall 16 and through a lint filter 27 supported in inclined condition by an inclined seat, integral to casing 14 and located beneath the drum 16. The filtered damp air then flows through a second passage 26, made in the lower section of casing 14, where it is propelled upwardly into a outflow duct 28 by a powered fan 29, before being released to atmospheric air.

Figure 2:
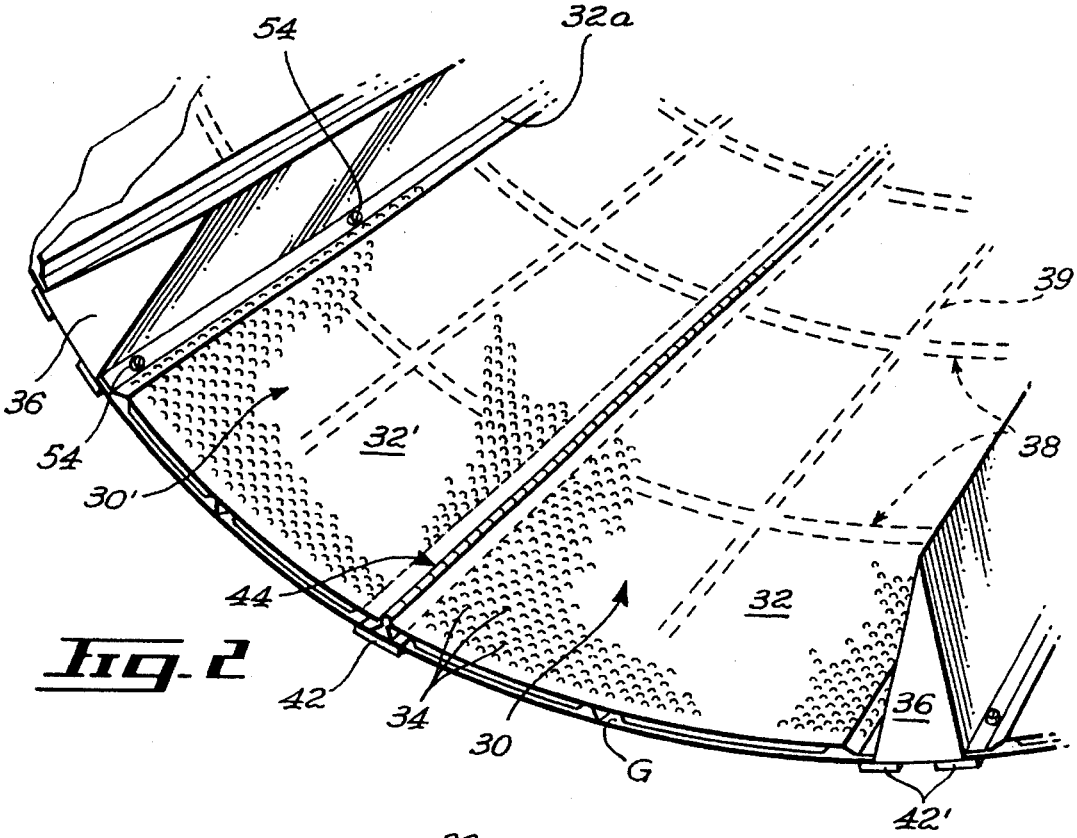
FIGS. 2 and 3 are fragmentary isometric views of the interior of the rotary clothes dryer drum, at an enlarged scale relative to FIG. 1, and sequentially suggesting how the panels inside the clothes dryer can be pivotally opened.

Accordingly with the teachings of the present invention, and as illustrated in FIGS. 2 and 3, there is provided a number of panel assemblies 30, 30', . . . being mounted for relative movement against the interior arcuate wall of the cylindrical drum 16. Each panel assembly 30, 30', . . . includes a main panel, 32 32', . . . having a plurality of bores 34, and being coated on both surfaces thereof with any one of a class of anti-adhesive compounds. Preferably, this anti-adhesive compound will be polytetrafluoroethylene (or PTFE). PTFE, also commonly known as TEFLON (a registered trademark), is a waxy, opaque, plastic material, having good thermal and wear resistance. This anti-adhesive compound prevents the fabric lint, the plastic material debris, and the general linen released during repeated drying of medical personnel clothes material, from adhering and sticking to the panel main wall 32, and also from getting stuck into and from clogging the bores 34 of the main panels 32. It is important of course to prevent the panel bores 34 from clogging, in view of maintaining through flow capability for both the incoming warm dry air flow and the outflowing stale damp air flow.

Each panel 32 is of a shape complementary to that of the contour of the drum 16, being preferably of generally arcuate shape, to follow the contour of the cylindrical drum 16, and may be rectangular in plan view, as illustrated. All the interior surface of the drum 16 should be covered by the panel assemblies 30, 30', . . . wherein the specific shape, size and number of such panel assemblies must be in relation to the size and shape of the drum 16. For example, the rectangular sheet panels 32 may have for example a size of 45.7 cm ×163.2 cm (18"×62¼"), for a cylindrical drum 16 having a diameter of 174 cm (68½") and a width of 163.2 cm (64 ½"), wherein five such sheet panels 32 would be needed. However, there should be left some drum wall area between each two pairs of successive adjacent panels 32, 32', and 32 32', for edgewisely accommodating the conventional shaker blocks 36 integrally depending from the drum 16 and having a triangular shape and being radially inturned (see FIGS. 1–3).

As shown in FIGS. 7 and 8, a number of short, inversely V-shape, stiffening pieces or spacer strips 38 are provided, extending tangentially of the drum 16, and being anchored against the interior face of the drum cylinder 16 at their edgewise flanges **38*a* by bolts 40. Similar but elongated stiffening pieces 39 are provided transversely of strips 38, being also anchored to drum 16 by bolts 40. A nut plate 42 is provided against the exterior wall of drum 16, for threaded engagement by bolts 40 (or alternately, for anchoring engagement by rivets, not shown), wherein the registering drum wall section 16 is firmly taken in sandwich between the spacer strip flanges 38*a* and the nut plate 42. The apex of the V strip 38** is radially inwardly located.

A piano hinge strip member 44, illustrated in FIGS. 5 and 6, is mounted to the V strip 38. Piano hinge member 44, for example of the Spaenauer 83 8800 model, includes three legs 46, 48, and 50, each having a number of lengthwisely spaced arcuate ears **46*a*, 48*a*, 50*a*, with the ears 46*a*, 48*a*, 50*a*, edgewisely interdigitating and being pivotally interconnected by an elongated pivot pin 52. Leg 50 of piano hinge member 44 is anchored flatly against the radially inward face of one inclined leg 38*a* of the V-shape strip 38, as shown in FIG. 7. Accordingly leg 50 is stationary while each leg 46 and 48 is pivotally movable relative to leg 50. Leg 46 is edgewisely anchored (preferably by spot welding) to a first perforated panel 32, and leg 48 is edgewisely anchored to a second perforated panel 32', whereby both panels 32 and 32' are pivotally carried by pivot axle 52** for radially inward pivotal motion.

As illustrated in FIGS. 2 and 3, each pivotable perforated panel 32 can be releasably locked in an operative, "closed" condition, by a number of screws 54 which extend threadingly through a panel flange **32*a*, located opposite piano hinge 44, and threadingly through a perforated drum wall section adjacent a shaker block 36. A screw support plate 42', similar to plates 42 of piano hinge members 44, is applied on the exterior face of drum 16, to receive and support screws 54. Moreover, each pivotable perforated panel 32 further includes on its radially outward (convex) face a number of integral transverse rigid lips 56 that constitutes spacer means (relative to drum wall 16) for maintaining an annular (radial) spacing gap G (FIG. 2) between the closed panel 32 and the registering section of drum 16**.

It can now be understood that, in operation, panels 32 are in their closed condition illustrated in FIG. 2. Damp clothes are loaded into drum 16, drum 16 is power rotated while warm dry air flows through the perforated walls 16 and 32 and into the drum 16, to dry the damp clothes. As the drum rotates, the humidity level of the damp clothes is progressively reduced while the clothes are repeatedly turned upside down by the radial shaker blocks 36, wherein lint and dust debris—among other debris—are formed from wear of the clothes fabric and other constituting materials (including plastic material e.g. from aprons). Damp stale air flows from the drum through perforated walls 16 and 32. The lint and dust debris are biased by this damp air outflow to move toward panels 32, and freely through the panel bores 34. Thanks to the PTFE coating of the panels 32, the lint and dust debris do not stick to the radially inward face of the panels 32, nor do they get stuck into and clog the panel bores 34. Accordingly, the lint and dust particles flow freely with the damp air flow through the panel bores 34 and into the radial gap G between the panels 32 and cylindrical drum wall 16.

Thereafter, airborne lint and dust particles continue to move with the airflow freely through and beyond the perforated wall 16 of the rotating drum, until they reach the lint filter 27 located spacedly beneath the drum 16. Lint, and macroparticles of dust beyond a threshold particulate diametral value, are intercepted and captured by the lint filter 27. Accordingly, lint and most dust do not escape to atmospheric air through the outflow ducts 26 and 28.

The third major element forming part of the medical personnel clothing being dried into the dryer unit 12, is plastic materials, integrated into the structural material of gloves, aprons, and the like elements of medical personnel clothing. With the present panel assemblies 32, these plastic parts of the clothing are prevented not only from accidentally adhering to panels 32—thanks to the anti-adhesive compound (PTFE) coating the panels 32—, but also from undesirably heat fusing with the panel 32 (as was sadly occurring with the rotating drum wall in prior art industrial clothes dryers).

Heat fusing of the plastic material against panels 32 is substantially prevented, because, during operation of the dryer unit 12, the average temperature of the perforated panels 32 is significantly lower than that of the rotating drum wall 16. Indeed, as the drum 16 rotates, important thermal transfer occur between air burner 25 and drum wall 16, under conductive and radiative forces, through the heat-conductive frame structural components of the dryer unit 12. On the contrary, since the main body of each panel 32 is radially spaced from drum wall 16, thermal transfers to panels 32 occur mainly by convection currents from warm drum wall 16. It is however noted that some minor thermal conduction does also occur, but at a much smaller level, both edgewisely of the panels 32 about flange 32*a* and hinge member 44, and sectionally along the spacer lips 56 which are transversely carried by the panels 32.

Once PTFE has worn off from panels 32, clothes debris accumulates against panels 32, clogging bores 34, wherein system maintenance is called upon. Maintenance is performed by unscrewing screws 54, to release the pivotal panel flange 32*a* from the drum 16, so as to enable panel 32 to pivot to an opened or radial position (FIG. 3). Each panel 32 is then completely removed by further unscrewing bolts 40 that interlock the piano hinge member 44 to the drum wall 16. Freshly coated perforated panels 32 can then immediately replace the worn out ones against the drum 16, thus minimizing expensive downtime of the drying machine. Care must be exercised during handling or transportation of the panels 32, so as not to damage (e.g. scratch) the panel surfaces, both before and after PTFE coating. The worn out panels 32 must be sent to a special processing area, where new coatings of PTFE are laid over the panels 32. More particularly, PTFE coating of the stainless steel panels 32 should be performed following these steps:

1) applying a first undercoating layer of TEFLON-S compound;
2) allowing the undercoating to cure;
3) applying a protective coating of TEFLON-P type PFA compound;
4) allowing the protective coating to cure.

Although this perforated panel assembly is particularly intended for use with industrial-type clothes dryers, it is not considered within the scope of the present invention to exclude this use to large, or even smaller, domestic-type clothes dryers.

Preferably, all the panel members 32, 32', . . . will be of constant shape and size, so as to be interchangeable about various interior wall locations of the drum 16.

All the materials used in the assembly of the present panel members 32 to the rotatable drum 16 should preferably be manufactured from stainless steel, or other suitable rigid material. The steel sheet panels 32 are preferably laminated, glossy, tempered, while having sustained electro-polishing and electrolytic burring treatments (to remove the rough edges generated when piercing the bores therethrough).

PTFE coating thickness on the panels 32 should remain substantially constant, preferably ranging between 25.4 to 30.5 micrometers (0.010 to 0.012 inches). All steel sheet welding should be performed by spot welding.

It is noted that the drum 16 as such does not form part of the invention, and need not be limited to a cylindrical shape, since other suitable shapes, e.g. cross-sectionally polygonal ones, could also be acceptable.

In FIG. 1, it is noted that references 15, 15', refer to conventional broombrushes fixedly carried by frame 14 and that edgewisely scrape transversely against the radially external face of rotating drum 16.

I claim:

1. A panel assembly for use inside the rotatable perforated drum of an industrial clothes dryer for heat drying damp clothes made at least partially from plastic material, said panel assembly comprising:

(a) a perforated panel member having a plurality of bores, said panel member having a shape adapted to be complementary to that of a peripheral sector portion of said drum;

(b) an anti-adhesive compound, coating said perforated panel member for preventing lint and dust debris and plastic parts of the clothes from accidentally sticking to the panel member, and for preventing clogging of said panel member bores by the lint and dust debris;

(c) mounting means, for edgewisely mounting said panel member releasably to the interior wall of said drum peripheral sector portion for relative movement of said panel member between a closed position, in which said panel member generally conforms to said drum peripheral sector portion spacedly therefrom, and an open position, in which said panel member extends transversely to said drum peripheral sector portion radially interiorly thereof; and (d) locking means, for releasably locking said panel member in its said closed position; wherein said panel member will sustain lower thermal transfer loads from thermal elements forming part of the clothes dryer, compared to those sustained by the rotatable drum, wherein heat fusing of the clothes plastic parts with said panel member is substantially prevented.

2. A panel assembly as defined in claim 1, wherein said anti-adhesive compound is polytetrafluoroethylene.

3. A panel assembly as defined in claim 2, wherein the thickness of said polytetrafluoroethylene coating over said panel member is substantially constant and ranges between about 25 and 31 micrometers.

4. A panel assembly as defined in claim 1, wherein said mounting means is a piano-hinge member, being fixedly anchored to said drum peripheral sector portion and pivotally mounting said panel member for radial displacement within said drum.

5. A panel assembly as defined in claim 4, wherein said panel member forms an arcuate quadrangular panel, for complementary engagement with an arcuate said sector portion of a cylindrical said drum.

6. A panel assembly as defined in claim 5, in combination with a second said panel assembly, both said panel members being hinged by the same said piano-hinge member to the drum.

7. A panel assembly as defined in claim 1, further including rigid spacer stiffening strips, carried by said panel member and projecting from its exterior face, said stiffening strips frictionally engaging said drum section in said closed position of the panel member; wherein conductive thermal transfer is limited to a minimum.

* * * * *